US005217574A

United States Patent [19]

Griggs

[11] Patent Number: 5,217,574

[45] Date of Patent: * Jun. 8, 1993

[54] PROCESS FOR OXYGEN DELIGNIFYING HIGH CONSISTENCY PULP BY REMOVING AND RECYCLING PRESSATE FROM ALKALINE PULP

[75] Inventor: Bruce F. Griggs, Columbia, S.C.

[73] Assignee: Union Camp Patent Holdings Inc., Wayen, N.J.

[ * ] Notice: The portion of the term of this patent subsequent to Feb. 4, 2009 has been disclaimed.

[21] Appl. No.: 686,062

[22] Filed: Apr. 16, 1991

Related U.S. Application Data

[63] Continuation-in-part of Ser. No. 489,845, Mar. 3, 1990, Pat. No. 5,085,734, which is a continuation of Ser. No. 311,669, Feb. 15, 1989, abandoned.

[51] Int. Cl.[5] ..... D21C 9/147; D21C 9/18

[52] U.S. Cl. ..... 162/19; 162/40; 162/56; 162/60; 162/65

[58] Field of Search ..... 162/19, 37, 39, 40, 162/18, 56, 60, 65, 88, 89, 90

[56] References Cited

U.S. PATENT DOCUMENTS

| | | | |
|---|---|---|---|
| 1,860,432 | 5/1932 | Richter . | |
| 2,926,114 | 2/1960 | Grangaard et al. | 260/212 |
| 3,024,158 | 3/1962 | Grangaard | 162/17 |
| 3,251,730 | 5/1966 | Watanabe | 162/56 |
| 3,274,049 | 9/1966 | Gaschke et al. | 162/65 |
| 3,384,533 | 5/1968 | Meylan et al. | 162/65 |
| 3,423,282 | 1/1969 | Rerolle et al. | 162/65 |
| 3,652,388 | 3/1972 | Croon et al. | 162/65 |
| 3,660,225 | 6/1972 | Verreyne et al. | 162/17 |
| 3,661,699 | 5/1972 | Farley | 162/65 |
| 3,740,310 | 6/1973 | Smith et al. | 162/65 |
| 3,759,783 | 9/1973 | Samuelson et al. | 162/40 |
| 3,832,276 | 8/1974 | Roymoulik et al. | 162/65 |
| 3,874,992 | 4/1975 | Liebergott | 162/66 |
| 3,888,727 | 6/1975 | Kenig | 162/65 |
| 3,951,733 | 5/1976 | Phillips | 162/65 |
| 4,080,249 | 3/1978 | Kempf et al. | 162/57 |
| 4,089,737 | 5/1978 | Nagano et al. | 162/19 |

(List continued on next page.)

FOREIGN PATENT DOCUMENTS

| | | |
|---|---|---|
| 1119360 | 3/1982 | Canada . |
| 1132760 | 10/1982 | Canada . |
| 1154205 | 9/1983 | Canada . |
| 062539 | 10/1982 | European Pat. Off. . |
| 106460 | 4/1984 | European Pat. Off. . |
| 106609 | 4/1984 | European Pat. Off. . |

OTHER PUBLICATIONS

Abrahamsson et al., "Oxygen/Sodium Carbonate Bleaching of Kraft Pulp Pretreated with Nitrogen Dioxide and Oxygen", Svensk Papperstidning (1983).

Allison, "Production of Bleached Softwood Pulp by Low Pollution Processes," Wood Sci. Technol. 17, pp. 129-137 (1983).

Andtbaka, "Low Kappa Pulping Followed by Oxygen Delignification", Appita, vol. 39, No. 2, (1986).

Brannland et al., "How to Cope with TOCL", International Oxygen Delignification Conference, (1987).

Carlberg et al., "Bleaching of Sulphite and Sulphate Pulps Using Conventional and Unconventional Sequences", TAPPI Proceedings 1982 Annual Meeting, p. 381.

(List continued on next page.)

*Primary Examiner*—Steve Alvo

[57] ABSTRACT

Unbleached pulp is combined with an aqueous alkaline solution while in a state of low consistency to distribute a first amount of alkaline material substantially uniformly throughout the pulp. The consistency of the pulp is then increased to above about 18%, and the high consistency alkali containing pulp is then treated with oxygen to effect delignification. The total amount of alkaline material applied to the pulp is between 0.8 and 7% by weight of oven dry pulp. High strength, low lignin pulps are subsequently formed which may be further bleached to high brightness with reduced amounts of chemicals.

25 Claims, 2 Drawing Sheets

U.S. PATENT DOCUMENTS

| | | | |
|---|---|---|---|
| 4,120,747 | 10/1978 | Sarge, III et al. | 162/117 |
| 4,155,806 | 5/1979 | Mannbro | 162/19 |
| 4,198,266 | 4/1980 | Kirk et al. | 162/29 |
| 4,220,498 | 9/1980 | Prough | 162/25 |
| 4,248,662 | 2/1981 | Wallick | 162/19 |
| 4,259,150 | 3/1981 | Prough | 162/40 |
| 4,274,913 | 6/1981 | Kikuiri et al. | 162/65 |
| 4,295,925 | 10/1981 | Bentvelzen | 162/19 |
| 4,295,926 | 10/1981 | Bentvelzen et al. | 162/57 |
| 4,298,426 | 11/1981 | Torregrossa et al. | 162/57 |
| 4,298,427 | 11/1981 | Bentvelzen et al. | 162/57 |
| 4,363,697 | 12/1982 | Markham et al. | 162/19 |
| 4,372,812 | 2/1983 | Phillips | 162/40 |
| 4,384,920 | 5/1983 | Markham et al. | 162/19 |
| 4,431,480 | 2/1984 | Markham et al. | 162/19 |
| 4,435,249 | 2/1984 | Markham et al. | 162/24 |
| 4,439,271 | 3/1984 | Samuelson | 162/19 |
| 4,450,044 | 5/1984 | Fritzvold et al. | 162/65 |
| 4,451,332 | 5/1984 | Annergren et al. | 162/30.1 |
| 4,459,174 | 7/1984 | Papageorges et al. | 162/40 |
| 4,568,420 | 2/1986 | Nonni | 162/65 |
| 4,595,455 | 6/1986 | Mannbro | 162/38 |
| 4,619,733 | 10/1986 | Kooi | 162/30.1 |
| 4,806,203 | 2/1989 | Elton | 162/65 |
| 4,834,837 | 5/1989 | Loquenz et al. | 162/65 |
| 4,840,703 | 6/1989 | Malmsten | 162/49 |

OTHER PUBLICATIONS

Casey, J. P., "Bleaching: A Perspective", *TAPPI Journal,* vol. 66, No. 7 (Jul. 1983) p. 95.

Christensen, P. K., "Bleaching of Sulphate Pulps with Hydrogen Peroxide".

DeSousa et al., "The influence of Chlorine Ratio and Oxygen Bleaching on the Formation of PCDF's and PCCD's in Pulp Bleaching", Tappi Journal (Apr. 1989).

Elton et al., "New Technology for Medium-Consistency Oxygen Bleaching".

Fossum et al., "Final Bleaching of Kraft Pulps Delignified to Low Kappa Number by Oxygen Bleaching", Tappi Jouranl pp. 60-62 (Dec. 1983).

Fujii, et al., "Oxygen Pulping of Hardwoods," TAPPI, Alkaline Pulping/Secondary Fibers Conference (Washington, D.C., Nov. 7-10, 1977).

Gellerstedt et al., "Singlet Oxygen Oxidation of Lignin Structures," *Singlet Oxygen,* Chapter 31, pp. 302-310, (Sep. 1976).

Germgard eta l., "Mathematical Models for Simulation and Control of Bleaching Stages", Nordic Pulp and Paper Research Journal, No. 1 (1987).

Gierer, "Chemistry of Delignification, Part 2: Reactions of Lignins During Bleaching", Word Science and Technology (1986).

Gierer, "Mechanisms of Bleach with Oxygen-Containing Species", ISWPC, (1987).

Gupta, et al., "OZ Prebleaching, Influence on Viscosity and Sheet Strength", TAPPI Symposium-Oxygen Delignification, p. 1 (1984).

Heimburger et al., "Kraft Mill Bleach Plant Effluents: Recent Developments Aimed at Decreasing Their Environmental Impact".

Heimburger et al., "Kraft Mill Bleach Plant Effluents: Recent Developments Aimed at Decreasing Their Environmental Impact Part II", TAPPI Journal, p. 69 (Nov. 1988).

Jamieson et al., "Integration of Oxygen Bleaching in the Brown Stock Washing System", Svensk Papperstidning (1973).

Kirk et al., "Low Consistency Oxygen Delignification in a Pipeline Reactor", TAPPI, vol. 61, No. 5.

Leopold, B., "The Pulp Mill of the Future", *Textile and Paper Chemistry and Technology,* p. 239.

Leopold, B., "The Pulping Process—Opportunity or Headache?", Proceedings of IPC Conference, Paper Science and Technology, May 8-10, 1979.

Liebergott, et al., "The Use of Ozone in Bleaching and Brightening Wood Pulps: Part I—Chemical Pulps" (TAPPI 1978).

Liebergott, et al., "The Use of Ozone or Oxygen in the First Bleaching State", *Ozone: Science and Engineering,* vol. 4, p. 109 (1982).

Liebergott, et al., "Bleaching a Softwood Kraft Pulp Without Chlorine Compounds", TAPPI Journal, p. 76 (Aug. 1984).

Liebergott, et al., "Bleaching a Softwood Kraft Pulp Without Chlorine Compounds", pp. 1-10.

Liebergott et al., "Comparison Between Oxygen and Ozone Delignification in the Bleaching of Kraft Pulps", TAPPI Proceedings—1981 Pulping Conference, p. 157.

McDonough, "Oxygen Bleaching's Pace Quickens", IPC Technical Paper Series, No. 246 (Jul. 1987).

Ohnishi, K., "Japan: Pulping, Bleaching", *Pulp and Paper* (Aug. 1978) p. 88.

Ow, et al., "Advances In Ozone Bleaching: Part II—Bleaching of Softwood Kraft Pumps With Oxygen and Ozone Combination", TAPPI Symposim—Oxygen Delignification (1984).

Partridge, H., "New Pulp Bleaching Developments", *CEP* (Jun. 1976).

Partridge, H., "An Overview of New Pulp Bleaching Developments", AIChE National Meeting, Paper No. 24a. (Sep. 7-10, 1975).

Perkins et al., "Advances in Ozone Bleaching—Part III—Pilot Plant Installations and Proposed Commercial Implementation".

Seifert et al., "Engineering Considerations in the Design of Oxygen Reactors", p. 309.

Singh, "The Bleaching of Pulp", TAPPI, 3rd ed., Chapter 7 (1979).

Smook, "Bleaching, Handbook For Pulp & Paper Technologies"—Chapter 11 (TAPPI).

Soteland, N., "Bleaching of Chemical Pulps With Oxygen and Ozone", Pulp and Paper Magazine of Canada, vol. 75, No. 4 (Apr., 1974) p. 91.

Soteland, N., "Bleaching of Chemical Pulps with Oxygen and Ozone", *Norsk Skogindustri* (Sep. 1978) p. 199.

Soteland, "Comparison Between Oxygen and Ozone Delignification of Sulphite Pulps", TAPPI Symposium-Oxygen Delignification p. 71 (1984).

Wong et al., "Toxicity, BOD and Color of Effluents From Novel Bleaching Processes", *Pulp and Paper Magazine of Canada,* vol. 79, No. 7 (Jul. 1978) p. 41.

PROCESS FOR OXYGEN DELIGNIFYING HIGH CONSISTENCY PULP BY REMOVING AND RECYCLING PRESSATE FROM ALKALINE PULP

CROSS REFERENCE TO RELATED APPLICATIONS

This application is a continuation-in-part of application Ser. No. 489,845, filed Mar. 3, 1990, now U.S. Pat. No. 5,085,734, which is a continuation of application Ser. No. 311,669, filed Feb. 15, 1989, abandoned.

FIELD OF INVENTION

The present invention relates to a method for the treatment of wood pulp, and more particularly to a method for oxygen delignification of brownstock to produce highly delignified pulp without deleteriously affecting strength.

BACKGROUND OF THE INVENTION

Wood is comprised in major proportion of cellulose and hemicellulose fiber and amorphous, non-fibrous lignin which serves to hold the fibrous portions together. The hemicellulose and the cellulose are sometimes referred to collectively as holocellulose. During the treatment of wood to produce pulp, the wood is transformed into a fibrous mass by removing a substantial portion of the lignin from the wood. Thus, processes for the production of paper and paper products generally include a pulping stage in which wood, usually in the form of wood chips, is reduced to a fibrous mass. Several different pulping methods are known in the art; they are generally classified as mechanical, chemical or semi-chemical pulping.

Chemical pulping methods include a wide variety of processes, such as the sulfite process, the bisulfite process, the soda process and the Kraft process. The Kraft process is the predominant form of chemical pulping.

Chemical pulping operations generally comprise introducing wood chips into a digesting vessel where they are cooked in a chemical liquor. In the Kraft process, the cooking liquor comprises a mixture of sodium hydroxide and sodium sulfide. After the required cooking period, softened and delignified wood chips are separated from the cooking liquor to produce a fibrous mass of pulp. The pulp produced by chemical pulping is called "brownstock." The brownstock is typically washed to remove cooking liquor and then processed for the production of unbleached grades of paper products or, alternatively, bleached for the production of high brightness paper products.

Since chromophoric groups on the lignin are principally responsible for color in the pulp, most methods for the bleaching of brownstock require further delignification of the brownstock. For example, the brownstock may be reacted with elemental chlorine in an acidic medium or with hypochlorite in an alkaline solution to effect this further delignification. These steps are typically followed by reactions with chlorine dioxide to produce a fully bleached product. Oxygen delignification is a method that has been used at an increasing rate in recent years for the bleaching of pulp because it uses inexpensive bleach chemicals and produces by-products which can be burned in a recovery boiler reducing environmental pollutants. Oxygen delignification is frequently followed by bleach stages which use chlorine or chlorine dioxide but require less bleach chemical and produce less environmental pollutants because of the bleaching achieved in the oxygen stage.

In some bleaching processes, the pulp is bleached while being maintained at low to medium levels of pulp consistency. Pulp consistency is a measure of the percentage of solid fibrous material in pulp. Pulps having a consistency of less than about 10% by weight are said to be in the low to medium range of pulp consistency. Processes which require bleaching at low to medium consistency are described in the following patents and publications: U.S. Pat. No. 4,198,266, issued to Kirk et al; U.S. Pat. No. 4,431,480, issued to Markham et al; U.S. Pat. No. 4,220,498, issued to Prough; and an article by Kirk et al. entitled "Low-consistency Oxygen Delignification in a Pipeline Reactor—A Pilot Study", TAPPI, May 1978. Each of the foregoing describe an oxygen delignification step that operates upon pulps in the low to medium consistency range.

U.S. Pat. No. 4,806,203, issued to Elton, discloses an alkaline extraction, preferably for chlorinated pulp, wherein the timed removal of alkaline solution is essential to prevent redepositing of dissolved lignin back onto the pulp. If too short or too long of a time period passes in this stage, the process shows little benefit.

Oxygen delignification of wood pulp can be carried out on fluffed, high consistency pulp in a pressurized reactor. The consistency of the pulp is typically maintained between about 20% and 30% by weight during the oxygen delignification step. Gaseous oxygen at pressures of from about 80 to about 100 psig is introduced into and reacted with the high consistency pulp. See, G. A. Smook, *Handbook for Pulp and Paper Technologists*, Chapter 11.4 (1982). In previous oxygen delignification operations, the pulp after cooking is washed and dewatered to produce a high consistency mat. The pulp mat is then covered with a thin film or layer of an alkaline solution, by spraying the solution onto the surface of the mat. The amount of alkaline solution sprayed onto the mat is about 0.8 to 7% by weight of oven dry pulp.

Previously used high consistency oxygen delignification processes have several disadvantages. In particular, it has now been found that spraying an alkaline solution onto a mat of high consistency pulp does not provide an even distribution of solution throughout the fibrous mass, notwithstanding the generally porous nature of such mats. As a result of this uneven distribution, certain areas of the high consistency mat, usually the outer portions, are exposed to excessive amounts of the alkaline solution. This excessive exposure is believed to cause nonselective degradation of the holocellulosic materials resulting in a relatively weak pulp, at least locally. On the other hand, other portions of the high consistency mat, typically the inner portions, may not be sufficiently exposed to the alkaline solution to achieve the desired degree of delignification. Thus, overall quality declines.

SUMMARY OF THE INVENTION

The present invention provides a novel process for obtaining enhanced delignification selectivity of pulp during a high consistency oxygen delignification process wherein the oxygen delignified pulp has greater strength and a lower lignin content than has been attainable by prior art processes.

In accordance with the present invention, a brownstock pulp is washed to an initial consistency. This initial consistency of the pulp is then reduced to less than about 10% by weight and preferably less than 5% by weight to form a low consistency pulp. Alkaline material is applied to the low consistency pulp by combining the low consistency pulp with a quantity of alkaline material in an aqueous alkaline solution in a manner to obtain a substantially uniform distribution of the desired amount of alkaline material throughout the pulp. This uniform distribution of alkaline material is sufficient to assist in the enhancement of delignification selectivity during high consistency oxygen delignification compared to processes where the alkaline material is only applied upon high consistency pulp or is only applied at very low amounts onto low consistency pulp.

To complete the application of the alkaline material to the pulp, the consistency of the pulp is then increased to at least about 18% to form high consistency pulp. The step of increasing the pulp consistency includes pressing or otherwise processing the low consistency pulp in a manner to remove pressate containing alkaline material while retaining the desired amount of alkaline material distributed throughout the pulp.

A predetermined quantity of this pressate may be retained in a holding tank, so that pressate may be continuously returned or recycled directly to the alkaline material combining step despite the intermittent or non-continuous operation of the consistency increasing step. All or at least a substantial portion (i.e., greater than 50% and preferably about 75-95%) of this pressate is directly recycled to the low consistency combining step. The remaining pressate portion can be directed to the brownstock pulp washer or to the plant recovery system to maintain water balance in the mixing chest.

The amount of alkaline material to be retained upon the high consistency pulp is at least about 0.8 to 7 percent by weight based on oven dry ("OD") pulp, and specifically between about 1.5 and 4 percent by weight for southern softwood and between about 1 and 3.8 percent by weight for hardwood. The pulp is then subjected to oxygen delignification whereby enhanced delignification is achieved.

The present invention also facilitates the pulp bleaching processes that follow the high consistency oxygen delignification of the alkaline material treated pulp. These processes utilize less bleaching chemicals to produce bleached paper products having superior strength compared to paper products made according to conventional high consistency pulp oxygen delignification processes. Alternatively, the process enables one to achieve better delignification selectivities, as evidenced by similar lignin contents (i.e., K Nos. or Kappa numbers) with higher strength (i.e., higher viscosities), after oxygen delignification compared to conventionally treated pulp. Also, the process of the invention enables one to achieve pulp which exhibits greater brightness compared to conventionally treated pulps when exposed to the same amount of bleaching chemical.

DESCRIPTION OF PREFERRED EMBODIMENTS

The present invention provides high quality, high strength, delignified wood pulp from Kraft pulp or pulps produced by other chemical pulping processes. The preferred starting material is unbleached brownstock pulp obtained by cooking wood chips or other fibrous materials in a cooking liquor, such as by the Kraft or Kraft AQ process.

Figure 1:
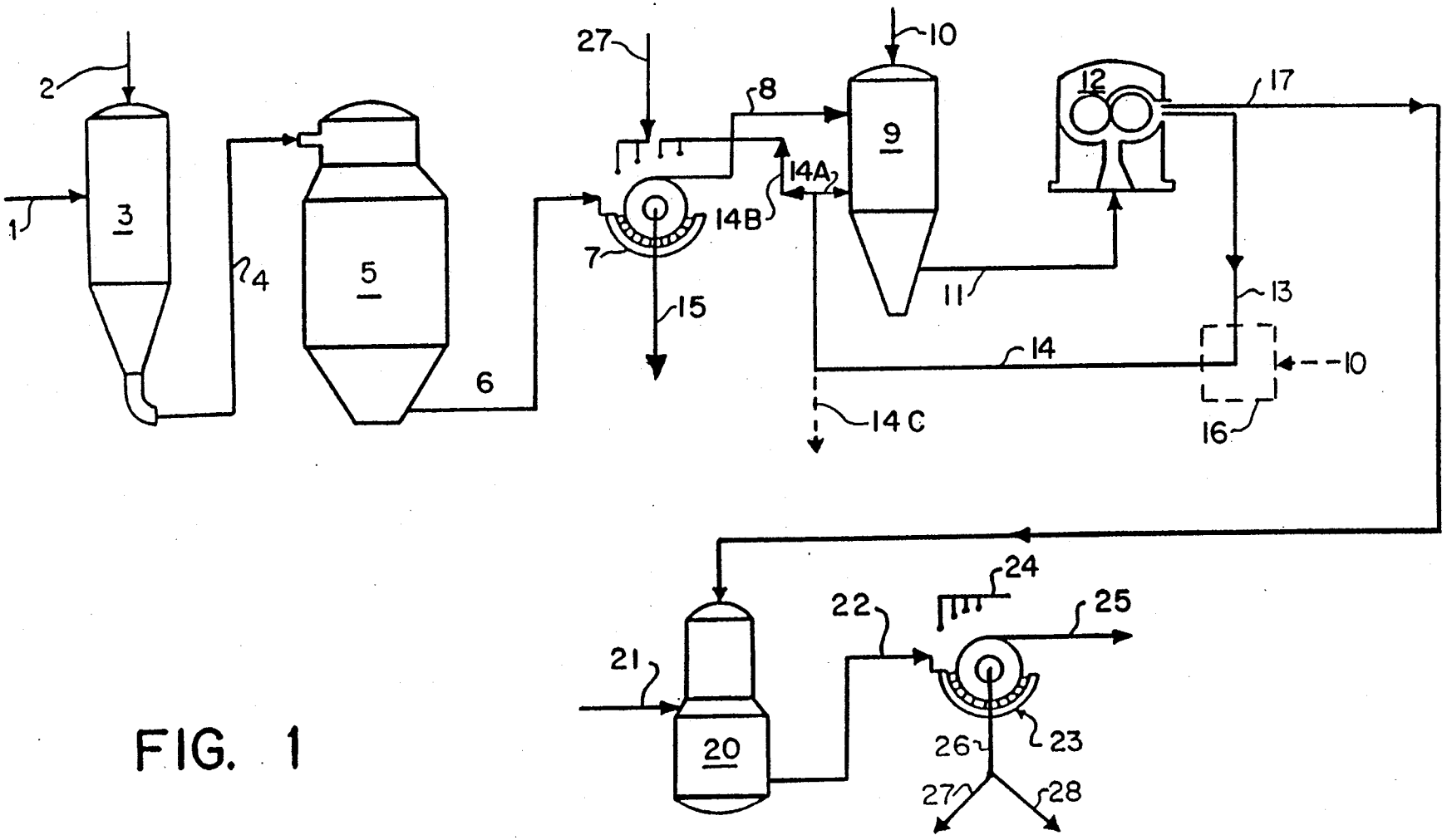
FIG. 1 is a schematic representation of the present invention.

With reference to FIG. 1, wood chips 1 and a white liquor 2 comprising sodium hydroxide and sodium sulfide are introduced into a digester 3. Sufficient white liquor should be introduced into the digester to substantially cover the wood chips. The contents of the digester are then heated at a temperature and for a time sufficient to allow the white liquor to substantially impregnate the wood chips and substantially complete the cooking reaction.

This wood chip cooking step is conventionally known as Kraft cooking or the Kraft process and the pulp produced by this process is known as Kraft pulp or Kraft brownstock. Depending upon the lignocellulosic starting material, the delignification results obtained with the conventional Kraft process may be increased by the use of extended delignification techniques or the Kraft-AQ process. Moreover, these techniques are preferred for obtaining the greatest degree of reduction in K No. of the pulp without deleteriously affecting the strength and viscosity properties of the pulp during the cooking stage.

When using the Kraft-AQ technique, the amount of anthraquinone in the cooking liquor should be an amount of at least about 0.01% by weight, based on the OD weight of the wood to be pulped, with amounts of from 0.02 to about 0.1% generally being preferred. The inclusion of anthraquinone in the Kraft pulping process contributes significantly to the removal of the lignin without adversely affecting the desired strength characteristics of the remaining cellulose. Also, the additional cost for the anthraquinone is partially offset by the savings in cost of chemicals utilized in the bleaching steps which follow oxygen delignification of the pulp.

Alternatively or additively to Kraft-AQ is the use of techniques for extended delignification such as the Kamyr MCC, Beloit RDH and Sunds Super Batch Methods. These techniques also offer the ability to remove more of the lignin during cooking without adversely affecting the desired strength characteristics of the remaining cellulose.

The digester 3 produces a black liquor containing the reaction products of lignin solubilization together with brownstock 4. The cooking step is typically followed by washing to remove most of the dissolved organics and cooking chemicals for recycle and recovery, as well as a screening stage (not shown) in which the pulp is passed through a screening apparatus to remove bundles of fibers that have not been separated in pulping. The brownstock 4 is then directed to a blow tank 5.

Brownstock 6 exiting blow tank 5 is directed to a washer 7, which washes the pulp to a first consistency. The washed pulp 8 is then introduced into a mixing chest 9 where it is substantially uniformly combined with sufficient fresh 10 and recycle 14A alkaline material for a time sufficient to distribute the desired amount of alkaline material throughout the pulp. During this treatment, the consistency of the brownstock pulp is reduced and maintained at less than about 10% and preferably less than about 5% by weight. The consistency of the pulp is generally greater than about 0.5%, since lesser consistencies are not economical to process in this manner. A most preferred consistency range is 0.5 to 4.5%.

One skilled in the art can select the appropriate quantities (i.e., concentrations and flow rates) of alkaline solution and pulp treatment times in this step to achieve a distribution of the desired amount of alkaline material throughout the pulp. In particular, an aqueous sodium hydroxide solution is combined with the low consistency pulp in an amount sufficient to provide at least about 0.8% to about 7% by weight of sodium hydroxide on pulp based on oven dry pulp after the consistency increasing step. A particularly useful sodium hydroxide source is oxidized white liquor.

One skilled in the art would clearly recognize and understand the difference between the "quantity" of alkaline material utilized in or combined with the low consistency pulp and the "amount" which is applied to or is retained upon the pulp. To retain the desired amount of alkaline material upon the pulp after the consistency increasing step, a significantly larger quantity of alkaline material must be combined with the low consistency pulp in mixing chest 9. Thus, the quantity of alkaline material which is utilized (i.e., present) in the mixing chest is always greater than the amount actually applied to (i.e., retained within or upon) the pulp after the consistency of the pulp is increased. Also, all alkaline material is added to the pulp in mixing chest 9 to obtain a uniform dispersal of alkaline material in and throughout the low consistency pulp which, after the consistency increasing step, achieves the amount applied to the pulp which is desired for high consistency oxygen delignification of the pulp. The preferred amount of alkaline material actually retained upon the high consistency pulp will generally be between about 1.5 and 4% for southern softwood and between about 1 and 3.8% for hardwood.

The low consistency mixing step includes uniformly combining the brownstock pulp with an aqueous alkaline solution for at least about 1 minute and preferably no more than about 15 minutes. The mixing step is completed when the aqueous alkaline solution is substantially uniformly distributed throughout the low consistency pulp. Treatment times of less than about 1 minute generally do not provide sufficient time to attain a substantially uniform distribution: this is typically attained after about 10 to 15 minutes of mixing. Although continuing the mixing for longer periods of time does not deleteriously affect the process, no further benefit with respect to the distribution of alkaline materials throughout the pulp is obtained for longer mixing times, and equipment capacities must be increased to provide longer residence times. Such larger capacity equipment increases the capital cost for installation of the process.

The mixing step of the present invention can be carried out over a wide range of temperature conditions. A temperature range of from about room temperature to about 150° F. is suitable, with temperatures ranging from about 90° F. to about 150° F. being preferred. Standard pressure or elevated pressure may be employed.

The quantity of aqueous alkaline solution present in the mixing step of the present invention can vary greatly according to the particular process parameters of the delignification reaction; such variation in the amount of aqueous alkaline material is within the scope of the present invention. As will be appreciated by those skilled in the art, the amount of alkaline solution effective for the purpose of the present invention will depend primarily upon the extent of delignification desired in the subsequent oxygen bleaching step and the strength of the particular solution being used. The aqueous alkaline solutions of the present invention preferably comprise a sodium hydroxide solution having a concentration of from about 20 to about 120 g/l. This solution is mixed with the low consistency pulp, so that the overall mixture has concentration of alkaline material of between 6.5 and 13.5 g/l, preferably around 9 g/l. Thus, for a 5 to 15 minute treatment of 3 to 5 percent consistency pulp at temperatures between 120° to 150° F. at these concentrations of alkaline material, a uniform distribution of such alkaline material is obtained throughout the pulp. According to preferred embodiments of the present invention, an aqueous sodium hydroxide solution is added to the low consistency pulp in an amount sufficient to provide from about 15 to about 30% by weight of sodium hydroxide based on OD pulp weight.

The alkaline material treated pulp 11 is forwarded to a thickening unit 12 where the consistency of the pulp is increased, for example, by pressing to at least about 18% by weight and preferably from about 25% to 35%. For the preferred embodiment described above, the consistency is increased to 29%; and the high consistency pulp 17 is directed to oxygen delignification reactor 20.

The pulp consistency increasing step also removes residual liquid or pressate 13, which contains alkaline material. To conserve chemical, this pressate is recycled. When the consistency of the pulp 8 entering the mixing chest 9 is on the same order (i.e., about equal or slightly greater) as that of the high consistency pulp 17 which exits the thickener 12, the quantity of alkaline material utilized in the combining step is minimized because all pressate is advantageously directly recycled back to the mixing chest 9, as shown in FIG. 1 at 14A and is retained within the low consistency pulp alkaline treatment stage. Additional alkaline material 10 which is needed to replace the amount which is applied to the pulp, is added to mixing chest 9.

Optionally, a holding tank 16 may be included to receive pressate 13. This holding tank 16 assists in the smooth, continuous operation of the process by being able to accumulate amounts of pressate 13 so as to provide an uninterrupted flow of pressate containing alkaline material to the mixing chest 9 despite intermittent or non-continuous generation of pressate 13 from thickener 12. Thus, holding tank 16 provides a reservoir of alkaline material which can be continuously directed to mixing chest 9 for use in the low consistency pulp alkaline treatment step. For example, this tank should be sized at about 6000 cubic feet in order to have sufficient volume to handle the pressate generated by the alkaline treatment process for a 1000 air dried tons per day ("ADT/d") plant.

As noted above, brownstock 6 is washed in washer 7. Although a conventional washer utilizing any appropriate source of plant water can be utilized for washing brownstock 6, it is advantageous to utilize a source of wash water which is recycled from other steps in the process. Thus, washer 7 is illustrated as including a split shower to receive wash water from separate downstream sources.

A first portion 27 of the oxygen stage washer 23 filtrate 26 can be used to advantage by being recycled to washer 7 to reduce the amount of water utilized by the process. This filtrate portion 27 preferably passes through a first shower at washer 7. A second shower directs a portion 14B of the pressate 14 onto the pulp. These portions 14B, 27 are used to wash the pulp 6, and to recycle alkaline material onto the pulp as it is washed. Most of the alkaline material in pressate portion 14B becomes associated with the pulp and enters into mixing chest 9. Washer effluent 15 is discharged to the plant recovery system to maintain the water balance in the mixing chest.

It is preferable to recycle pressate directed into mixing chest 9 for use in the low consistency alkaline treatment step, rather than to the second shower of washer 7. This avoids the possible loss of alkaline material to the recovery system which would occur if the pressate 14 was introduced into the washer 7 due to "breakthrough" into the effluent of the washer.

When the consistency of brownstock 6 entering washer 7 is on the same order as that exiting thickener 12, it is possible to operate the process shown in FIG. 1 with no discharge of pressate from thickener 12. A closed system is achieved, whereby all pressate is directly recycled to mixing chest 9. The amount of alkaline material "lost" due to retention upon the increased consistency pulp is easily replaced by additional alkaline material 10 added to the mixing chest 9 or holding tank 16. In this arrangement, the quantities of alkaline material to be utilized in the process would be minimized, since no alkaline material is lost by intentional or unintentional discharge to the plant recovery system.

When the consistency of brownstock 6 entering washer 7 is lower than that of pulp 17 exiting thickener 12, a buildup of liquid gradually occurs in the mixing chest 9 due to the recycle of pressate 14A. To remedy this situation, a portion 14C of the pressate must be discharged to the plant recovery system to maintain water balance in mixing chest 9. Generally, a substantial portion of greater than 50% and preferably about 75-95% of pressate 14A is directly recycled to mixing chest 9 with the remaining pressate portion being discharged at 14C to the plant recovery system. Alternatively, the remaining pressate portion may be directed to the split shower of washer 7 via 14B.

The flow of pressate 14 can be divided so that portion 14A is continuously directed to the mixing chest 9 while portion 14B is continuously directed to the washer 7 via the split shower. For this arrangement, pressate portion 14A would again constitute at least 50% and preferably, between about 75 and 95% of the total pressate stream 14, with pressate portion 14B constituting the balance. The wash filtrate 15 from washer 7 is then discharged to the plant recovery system to maintain water balance in the mixing chest 9. Also, the second portion 28 of the oxygen stage washer 23 filtrate 26 is discharged to the plant recovery system.

The alkaline material containing pulp 17 is then forwarded to the oxygen delignification reactor 20 where it is contacted with gaseous oxygen 21 by any of a number of well known methods. Suitable conditions for oxygen delignification according to the present invention comprise introducing gaseous oxygen at about 80 to about 100 psig to the high consistency pulp while maintaining the temperature of the pulp between about 90° and 130° C. The average contact time between the high consistency pulp and the gaseous oxygen ranges from about 15 minutes to about 60 minutes.

After oxygen delignification in reactor 20, the delignified pulp 22 is forwarded to a washing unit 23 wherein the pulp is washed with water 24 to remove any dissolved organics and to produce high quality, low color pulp 25. From here, pulp 25 can be sent to subsequent bleaching stages to produce a fully bleached product.

Additional advantages of the present invention can be obtained during the subsequent bleaching of the oxygen delignified pulp 25. Such bleaching can be conducted with any of a wide variety of bleaching agents, including ozone, peroxide, chlorine, chlorine dioxide, hypochlorite or the like. When conventional chlorine/chlorine dioxide bleaching processes are used to increase the degree of brightness of the pulps which have been treated with alkaline material as described above, a substantially reduced amount of total active chlorine is used compared to the bleaching of pulps which are oxygen delignified by prior art techniques. The total amount of chlorine-containing chemicals utilized according to the present invention is reduced by about 15 to 35% by weight compared to the amount needed for the same starting pulp which is not treated with alkaline material at low pulp consistency. Similarly, when the chlorine/chlorine dioxide treated pulp is followed by an alkaline extraction stage, substantially reduced amounts of alkaline material are needed in this stage compared to a bleaching process for pulps which have not been uniformly combined with alkaline material at low consistency. The amount of alkaline material utilized in the extraction step would be reduced by about 25 to 40% by weight for pulp treated with alkaline material at low consistency as disclosed herein.

In addition to providing cost advantages with respect to the reduced amounts of chemical necessary for such treatments, the process of the present invention also reduces the amounts of environmental pollutants caused by the use of chlorine, since reduced amounts of chlorine are used. Furthermore, due to the lower usage of chemicals in this portion of the system, the amount of contaminants in the waste water from the plant which is to be treated is correspondingly reduced with similar savings in waste water treatment facilities and related costs.

EXAMPLES

In order to illustrate the benefits and superior performance of the methods of the present invention, several tests were conducted utilizing the treatment procedure depicted in FIG. 1.

As the term is used herein, delignification selectivity is a measure of cellulosic degradation relative to the extent of lignin remaining in the pulp and is an indication of the ability of the process to produce a strong pulp with low lignin content. Differences in delignification selectivity for oxygen delignification of a particular pulp can be shown, for example, by comparing the ratio of pulp viscosity to K No. or Kappa number. For this invention, the lignin content of the pulp may be measured by either K No. or Kappa number. One skilled in the art can recognize the difference between these values and can convert one number to the other, if desired. Unless otherwise specified, 40 ml K Nos. will be reported.

The viscosity of a bleached pulp is representative of the degree of polymerization of the cellulose in the bleached pulp and as such is representative of the pulp.

On the other hand, K No. represents the amount of lignin remaining in the pulp. Accordingly, an oxygen delignification reaction that has a high selectivity produces a bleached pulp of high strength (i.e., high viscosity) and low lignin content (i.e., low K No.).

Example 1

Prior art high consistency pulp alkaline treatment

Southern pine Kraft brownstock having a K No. of about 24 (Kappa number of 30.9) was pressed without alkaline solution treatment to a consistency of about 30–36% by weight to produce a high consistency mat of brownstock. The mat of brownstock was sprayed with a 10% sodium hydroxide solution in an amount sufficient to produce approximately 2.5 weight percent sodium hydroxide based on pulp dry weight. Dilution water was added in an amount sufficient to adjust the brownstock mat to about 27% consistency. The high consistency brownstock mat was then subjected to oxygen delignification using the following conditions: 110° C., 30 minutes, 80 psig $O_2$. The oxygen delignified pulp produced according to this procedure was tested and found to have a K No. of 13 (Kappa number of 15.2) and a CED viscosity of about 14.8 cps. This oxygen delignified pulp was further bleached by known technology. The strength and physical properties of both the oxygen delignified pulp and the fully bleached pulp are shown in Tables 1 and 2, respectively.

TABLE 1

Comparison of Oxygen Stage Delignification Results on Pulps Produced by Example 1 and Example 2

| | EXAMPLE 1 | EXAMPLE 2 |
|---|---|---|
| K No. | 13 | 9 |
| Viscosity (cps) | 14.8 | 14.0 |
| Ratio of Viscosity/K No. | 1.14 | 1.55 |

TABLE 2

Comparison of Fully Bleached Strength Properties of Pulps Produced by Example 1 and Example 2

| | EXAMPLE 1 | | EXAMPLE 2 | |
|---|---|---|---|---|
| Final G.E. brightness, % | 83 | | 83 | |
| C.S. Freeness, ml. | Breaking Length-km | Tear Factor, $Dm^2$ | Breaking Length-km | Tear Factor, $Dm^2$ |
| 658 | 6.42 | 55.7 | 7.00 | 55.5 |
| 516 | 8.25 | 73.6 | 8.35 | 67.4 |
| 337 | 8.80 | 74.1 | 9.07 | 71.8 |

Bleaching of the oxygen delignified pulp was conducted in three stages: chlorine, caustic extraction and chlorine dioxide. The final bleached pulp of 83 G.E. brightness was obtained using the bleaching and extraction conditions of Table 3 and the chemical charges (percent based on OD pulp) listed in Table 4. Also, the pulps were well washed between bleaching stages.

TABLE 3

Bleaching Conditions in the Chlorine, Extraction and Chlorine Dioxide Stages for Example 1 and Example 2

| | |
|---|---|
| Chlorine Stage | |
| Time, min. | 15 |
| Temperature, °C. | 50 |
| Consistency, % | 3 |
| Extraction Stage | |
| Time, min. | 60 |
| Temperature, °C. | 70 |
| Consistency, % | 12 |
| Chlorine Dioxide Stage | |
| Time, min. | 120 |
| Temperature, °C. | 60 |
| Consistency, % | 12 |

TABLE 4

Bleach Chemical Usage in Chlorine, Extraction and Chlorine Dioxide Stages

| | EXAMPLE 1 | EXAMPLE 2 |
|---|---|---|
| Chlorine Stage | | |
| Chlorine, % on fiber | 3.6 | 2.4 |
| Chlorine Dioxide, % | 0.6 | 0.4 |
| Extraction Stage | | |
| Sodium Hydroxide, % | 1.5 | 1.5 |
| Chlorine Dioxide Stage | | |
| Chlorine Dioxide, % | 0.28 | 0.23 |

Examples 2–5

Low consistency pulp alkaline treatment

Examples 2–5 illustrate the benefits in degree of delignification and delignification selectivities obtained during high consistency oxygen delignification for pulps which are treated with alkaline material only at low consistency.

Example 2

The same pine Kraft brownstock as used in Example 1 was introduced into a mixing chest, such as 9 of FIG. 1. Sufficient dilution water was added to obtain a brownstock consistency of about 3% by weight in the mixing chest. A sufficient volume of 10% NaOH solution was added to effect a 30% NaOH addition based on OD pulp. The brownstock and the aqueous sodium hydroxide solution were uniformly mixed at room temperature for about 15 minutes to combine the alkaline material with the brownstock. The resulting alkaline material containing brownstock was then pressed to a consistency of about 27% by weight. After pressing, the sodium hydroxide on the fiber equaled about 2.5%, as in Example 1. The alkaline material treated brownstock was then bleached according to the oxygen delignification procedure described in Example 1. The oxygen delignified pulp was then washed to remove organics. The resulting oxygen stage pulp had a K No. of 9 (Kappa number of 10.8) and a CED viscosity of 14.0. The oxygen bleached pulp was further bleached by known technology at the conditions shown in Example 1. The properties of the oxygen delignified pulp and the fully bleached pulp of this Example are also shown above in Tables 1 and 2, respectively.

As can be seen from a comparison of Examples 1 and 2, the procedure of Example 2 produced an oxygen delignified pulp having greater delignification (lower K No.) at about the same viscosity than the prior art method of Example 1 which applies all the alkaline material upon the high consistency pulp. Furthermore, utilizing a low consistency alkaline treatment of pulp in accordance with Example 2 provides enhanced delignification without significant change in strength properties. Thus, increased delignification selectivity is achieved.

As a result of the lower K Nos. of pulp produced by Example 2, subsequent bleaching steps can be adjusted to accommodate the higher delignified pulp. Thus, the bleaching stages for such pulp require less bleaching agents (as shown in Table 4) or shorter bleaching times than for pulp which is not treated with alkaline material at low consistency.

Example 3

Pulp produced from softwood (pine) in a process similar to that of Example 2 is compared to that produced conventionally (i.e. with no low consistency alkaline treatment step) as in Example 1. The average sodium hydroxide dosage applied only to high consistency pulp for subsequent oxygen delignification of the pulp was found to be 45 pounds per oven dried ton (lb/t) or 2.3%. At that level, the average reduction in K No. across the oxygen delignification reactor was 10 units. For the same level of sodium hydroxide applied only to the low consistency pulp prior to high consistency oxygen delignification, an average K No. drop during delignification was found to be 13 units: a 30% increase compared to the prior art.

The average K No. and viscosity for conventional pulp was 12.1 and 14.4 cps, respectively. For the low consistency alkaline material treatment process, the average K No. at essentially the same viscosity (14.0 cps) was 8.3, an increase in delignification selectivity of about 41% (1.69 vs. 1.19), as shown in Table 5.

Bleach plant response for pulps prepared according to the above low consistency alkaline treatment process was compared to that for pulps prepared conventionally and is shown below in Table 5.

TABLE 5

Pulp Property and Bleach Chemical Comparison (Pine)

| | Conventional | Low Consistency Treated |
|---|---|---|
| Digester | | |
| K No. | 21.9 | 20.5 |
| Viscosity (cps) | 21.5 | 20.5 |
| Ratio of Viscosity/K No. | .98 | 1.0 |
| $O_2$ Delignification Stage | | |
| K No. | 12.1 | 8.3 |
| Viscosity (cps) | 14.4 | 14.0 |
| Ratio of Viscosity/K No. | 1.19 | 1.69 |
| Caustic, lb/t | 39.4 | 46.0 |
| Delignification (%) | 44.7 | 59.5 |
| Bleach Plant | | |
| Chlorine/Chlorine Dioxide Stage | | |
| $Cl_2$, lb/t | 51.2 | 34.4 |
| $ClO_2$, lb/t | 7.0 | 4.6 |
| Tot. Act. Cl, lb/t | 69.4 | 46.4 |
| Extraction Stage | | |
| NaOH, lb./t | 35.2 | 23.8 |
| Chlorine Dioxide Bleach Stage | | |
| $ClO_2$, lb/t | 10.6 | 9.0 |
| Viscosity (cps) | 12.6 | 11.9 |
| Dirt | 5.6 | 2.5 |

Table 5 illustrates that total active chlorine usage in the next stage of bleaching was reduced by about ⅛0 (i.e., 69.4 pounds per ton vs. 46.4 pounds per ton). In addition, sodium hydroxide requirements for the extraction tage were also reduced by about ⅓ (24 lb/t vs. 35 lb/t). Chlorine dioxide in the final bleaching stage was reduced by about 1/6 (9 lb/t vs. 10.6 lb/t).

Example 4

Comparison tests similar to Example 3 were carried out for hardwood pulp. Again, it was found that a significantly larger K No. drop during the oxygen delignification reaction is achieved using a treatment process where alkaline material is applied only to low consistency pulp compared to conventional processing. The sodium hydroxide dosage for oxygen delignification of hardwood is 27 lb/t, or 1.4%. A K No. drop of about 5 units during the delignification step was obtained for the conventional process. For the same level of sodium hydroxide utilized according to the above low consistency process, an average K No. drop of about 7.3 units was obtained, an increase of almost 50%.

The average hardwood K No. and viscosity were found to be 7.6 and 16 cps, respectively. For the above low consistency treatment, a K No. of 6 and a viscosity of 17.7 was obtained. Also, the K No. at the same viscosity as the prior art alkaline material treated pulp (16 cps), was found to be 5.8. An increase of delignification selectivity of about 40% (2.95 vs. 2.10) is achieved, as shown in Table 6.

Delignification selectivity can also be expressed in terms of the change in viscosity versus the change in K No. between brownstock and delignified pulps. In comparing pulps which are treated with alkaline material only at low consistency to those of the prior art, there is a greater increase in delignification selectivity for increased degrees of delignification. For a change in K No. of 4 units, the average change in viscosity was 4 cps for pulps produced by the conventional process. By contrast, the change in K No. for the same change in viscosity for pulps produced by the low consistency pulp treatment was 7 units. Expressed in terms of a selectivity ratio, the selectivity for the low consistency treated pulp was 1.75 and that for the conventional process was 1 (cps/K No.), an increase of about 75%.

A comparison of bleach plant response of oxygen delignified pulps prepared using the above low consistency alkaline material treatment in terms of bleach chemical application is compared to conventionally prepared oxygen delignified pulps in Table 6.

TABLE 6

Pulp Property and Bleach Chemical Comparison (Hardwood)

| | Conventional | Low Consistency Treated |
|---|---|---|
| Digester | | |
| K No. | 12.3 | 13.0 |
| Viscosity (cps) | 21.6 | 23.4 |
| Ratio of Viscosity/K No. | 1.75 | 1.80 |
| $O_2$ Delignification Stage | | |
| K No. | 7.6 | 6.0 |
| Viscosity (cps) | 16.0 | 17.7 |
| Ratio of Viscosity/K No. | 2.10 | 2.95 |
| Caustic, lb/t | 27.6 | 26.4 |
| Delignification (%) | 38.0 | 54.0 |
| Bleach Plant | | |
| Chlorine/Chlorine Dioxide Stage | | |
| $Cl_2$, lb/t | 27.0 | 22.7 |
| $ClO_2$, lb/t | 5.6 | 4.7 |
| Tot. Act. Cl, lb/t | 41.6 | 34.9 |
| Extraction Stage | | |
| NaOH, lb./t | 18.9 | 13.3 |
| Chlorine Dioxide Bleach Stage | | |
| $ClO_2$, lb/t | 5.5 | 4.7 |

TABLE 6-continued

| Pulp Property and Bleach Chemical Comparison (Hardwood) | | |
|---|---|---|
| | Conventional | Low Consistency Treated |
| Viscosity (cps) | 14.6 | 14.9 |
| Dirt | 32.0 | 34.0 |

Table 6 illustrates that total active chlorine usage in the chlorine stage was reduced by about 1/6 (i.e., 34.9 lb/t compared to 41.6 lb/t), while caustic requirements for the extraction stage were reduced by more than 29% (i.e., 13.3 lb/t vs. 18.9 lb/t) compared to prior art pulp. The chlorine dioxide in the final bleaching stage was reduced by more than 14% (i.e., 4.7 lb/t vs. 5.5 lb/t). The final pulp properties with regard to viscosity and dirt values were essentially the same.

Example 5

To illustrate the effect of low consistency alkaline material treatment on pulp prior to oxygen delignification and its contribution to the overall effectiveness of Kappa drop and total yield, the Kappa number and yield were determined for both conventional and low Kappa number Kraft/AQ brownstocks. The results are presented in Table 7.

TABLE 7

| | | LOW CONSISTENCY ALKALINE TREATMENT | | | OXYGEN DELIGNIFICATION | | |
|---|---|---|---|---|---|---|---|
| Brownstock | Time (Min.) | Initial Kappa Number | Final Kappa Number | Yield (%) | Kappa Number | Yield (%) | Final Viscosity (CPS) |
| [1]Conven. | 5 | 28.1 | 26.5 | 99.5 | 12.0 | 95.2 | 14.7 |
| [2]Conven. | 15 | 28.1 | 27.5 | 98.7 | 13.4 | 96.3 | 15.1 |
| [3]K/AQ | 5 | 21.6 | 20.3 | 100.0 | 8.9 | 96.7 | 15.2 |
| [4]K/AQ | 5 | 21.6 | — | — | 8.1 | 97.2 | 13.9 |

[1]2.4% NAOH
[2]2.1% NaOH
[3]2.1% NaOH
[4]2.6% NaOH

For a conventional kraft brownstock having a Kappa number of 28.1 treated with sodium hydroxide (2.4% on pulp after pressing) at 3% consistency for 5 minutes, the starting Kappa number decreased 1.6 units to a post treated Kappa number of 26.5. This represented a 9.6% contribution to the total Kappa number drop experienced following alkaline treatment and oxygen delignification (Kappa number of 12.0). The yield across the low consistency alkaline treatment stage was 99.5%. Approximately half of the 0.5% loss in yield can be attributed to loss of lignin with the remainder due to a loss in carbohydrates. The total yield after oxygen delignification was 95.2%.

The same starting brownstock was treated with sodium hydroxide (2.1% on pulp after pressing) at 3% consistency for 15 minutes. The starting Kappa number decreased 0.6 units to a Kappa number of 27.5. This represented a 4.2% contribution to the total Kappa number drop experienced following low consistency alkaline treatment and oxygen delignification (Kappa number of 13.4). The yield across the alkaline treatment stage was 98.7%.

For a low Kappa number kraft/AQ brownstock treated sodium hydroxide (2.11% on pulp after pressing) at 3% consistency for 5 minutes, the Kappa number decreased 1.3 units to 20.3. This Kappa number drop represented a 10% contribution to the total Kappa number drop experienced following oxygen delignification (Kappa number of 8.9). There was essentially no yield loss detected across the alkaline treatment stage. The total yield loss following oxygen delignification was 96.7%. A second oxygen delignification of the same kraft/AQ starting brownstock resulted in a similar Kappa number of 8.1 and yield of 97.2%.

This Example 5 shows that no significant amount of delignification occurs during the low consistency alkaline treatment of the pulp. This example also shows that there is no significance to the time of treatment with alkaline material at low consistency up to about 15 minutes. As is further shown by Examples 2–5, however, the low consistency alkaline treatment does significantly increase the relative amount of delignification obtained during subsequent high consistency oxygen delignification step as compared to pulps treated in the conventional manner. This example also shows that the process is effective with a low Kappa number brownstock in taking the pulp to a very low Kappa number without any significant decrease in viscosity.

The uniform distribution of the alkaline material throughout the pulp during the low consistency combining step ensures that the pulp fibers are more optimally associated with the alkaline material than is otherwise possible according to prior techniques. This results in enhanced delignification selectivity during subsequent oxygen delignification in that the delignified brownstocks have strength and degrees of delignification that are generally superior to those attainable by the prior art. Also, the delignification selectivity of the oxygen delignification reaction is unexpectedly improved.

When alkaline material is applied only to high consistency pulp as in the prior art, a delignification (i.e., reduction in K No.) of up to 50% can be achieved without substantially damaging the cellulose portions (and thus without substantially reducing the strength) of the pulp. In the present invention, it is possible to obtain a reduction in K No. for the incoming pulp of greater than 50% and generally at least about 60% during oxygen delignification with essentially no damage to the cellulose portion of the pulp. Reductions of 70% and more can be achieved, if desired.

For example, upon entering the oxygen delignification stage, pulp K Nos. for the particular pulp range from about 10 to 26, depending upon the type of wood and type of pulping conducted upon the particular wood. After delignification, the K No. is reduced to about 5 to 10. For softwood pulp, K Nos. generally range from 20–24 (target of 21) prior to delignification, while after delignification, the K Nos. are in the range of 8–10. For hardwood pulp, K Nos. of 10–14 (target 12.5) prior to are generally obtained by the present process.

For either type of pulp, the viscosity prior to delignification is generally about 19 or greater, while after delignification is above about 13 (generally 14 or above for softwood and 15 or above for hardwood). Typically, this change in viscosity from before to after delignification would be about 6 cps. or less. Moreover, it has been found that the change in viscosity per change in K No. is a constant for decreases in K No. up to about 17 units.

Thus, delignification selectivity is enhanced by the low consistency alkaline material combining step, with an increase of at least 20% in delignification compared to prior art delignification processes. The avoidance of deterioration of the cellulose component of the pulp is evident by the minimal change in viscosity of pulp from before to after oxygen delignification.

Example 6

Figure 2:
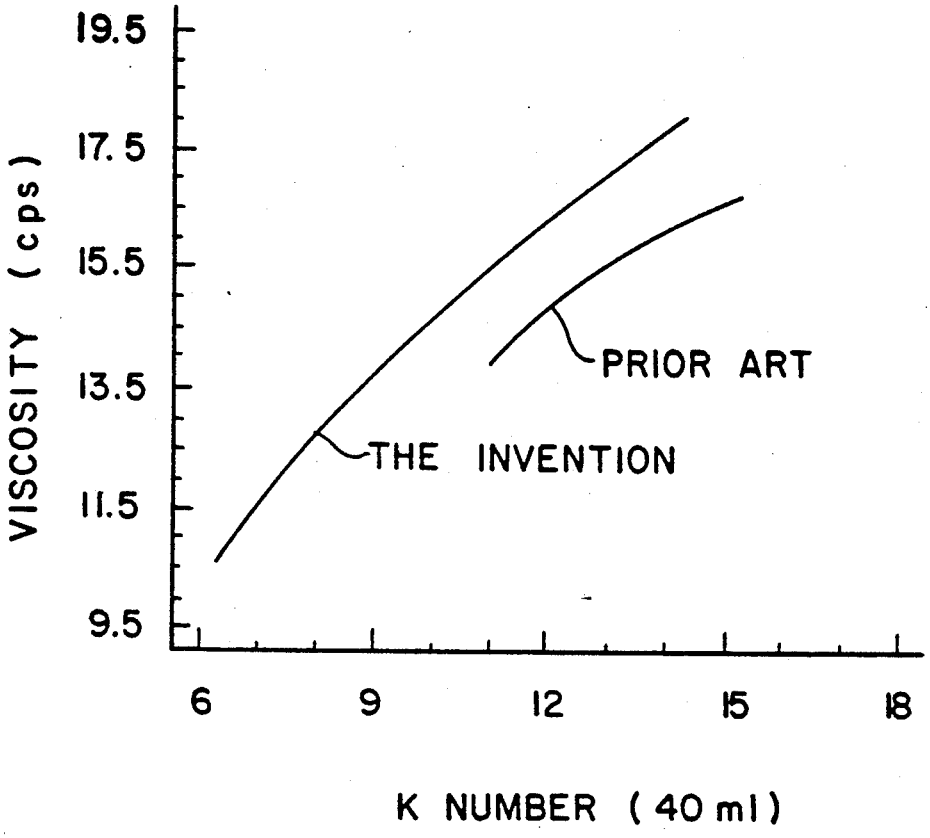
FIG. 2 is a graph showing the relationship between pulp viscosity and K No. for softwood pulps treated with alkaline material and delignified by oxygen according to the invention compared to those representative of the prior art.

The data presented in Examples 2-5, along with numerous other predicted and observed values, have been compiled for softwood pulp in graphical form in FIG. 2. FIG. 2 also includes curves generated from combined data from actual tests, and numerous other predicted and observed results, which illustrates the relationship of viscosity to K No. for softwood from the prior art pulp treatment process of Example 1.

As shown in FIG. 2, the prior art process of Example 1 achieves typical pulp properties after oxygen delignification defined by the curve labeled Prior Art. It is desirable to maintain pulp strength, as measured by viscosity, at higher viscosity levels, while achieving effective delignification as measured by a decrease in K No. FIG. 2 illustrates that enhanced delignification (lower K Nos.) may be attained at a given viscosity value according to the curve representing the invention, for a low consistency pulp alkaline material treatment as compared to the lesser delignification and viscosity values according to the Prior Art curve.

Example 7

The following laboratory tests are included to further illustrate how to achieve a uniform distribution of alkaline material upon the pulp in accordance with the process of the present invention.

An unbleached brownstock pine pulp was prepared having a K No. of 19.54 and a viscosity of 24.9. Two samples of this pulp at a consistency of 7.7% were treated with 3% NaOH at a temperature of 60° C. for 1 and 15 minutes, respectively. Thereafter, the consistency of the pulp was increased to 27% and the NaOH content of the pulp was found to be about 0.67%. This pulp was directed to an oxygen delignification reactor at a pressure of 80 psi and a temperature of 110° C. for 30 minutes without the further addition of alkaline material.

Next, two additional samples of the unbleached pulp, each at a consistency of 3%, were treated with a NaOH application of about 35% at a temperature of 60° C. for 1 and 15 minutes, respectively. Thereafter, the consistency of the pulp was increased to 27%, while retaining a NaOH content of 3% throughout the pulp, and the pulp was directed to an oxygen delignification at a pressure of 80 psi and a temperature of 110° C. for 30 minutes without the further addition of alkaline material. The results are shown in Table 8 below:

TABLE 8

| Sample | Consistency % | Mixing Time (minutes) | Properties after Oxygen Delignification: K No. (25 ml) | Viscosity (cps) |
|---|---|---|---|---|
| A | 7.7 | 1 | 17.37 | 23.2 |
| B | 7.7 | 1 | 17.43 | 22.6 |
| C | 7.7 | 15 | 17.77 | 24.3 |
| D | 7.7 | 15 | 17.34 | 22.0 |
| E | 3.0 | 1 | 8.74 | 14.8 |
| F | 3.0 | 1 | 8.34 | 14.8 |
| G | 3.0 | 15 | 8.24 | 15.3 |
| H | 3.0 | 15 | 8.73 | 14.3 |

The treated pulp of samples E-H retains a much greater amount (i.e., 3%) of sodium hydroxide than that of samples A-D, because a much larger quantity of sodium hydroxide is mixed with the pulp. Samples E-H show a decrease in K No. of the pulp of at least about 55.3%, while the K No. decrease of Samples A-D is much smaller and is, at best, about 11.3%. Thus, the samples (E-H) treated in accordance with the process of the present invention increases delignification by about 49.6% over the comparative samples.

For the same unbleached brownstock pulp of this example, the preceding tests were repeated with the following changes:

| | Modification 1 | Modification 2 |
|---|---|---|
| 1st Stage: NaOH, % on pulp | 3 | 24 |
| Consistency, % | 3.5 | 3 |
| Temperature, °C. | 48 | 48 |
| Oxygen stage: NaOH, % on pulp | 0.44 | 3 |
| Consistency, % | 20 | 20 |

The NaOH treatment time for each modification was conducted both at 2 minutes and 15 minutes. As noted, the consistencies of the unbleached pulp were essentially the same (3.5% vs. 3%). Results are shown in Table 9.

TABLE 9

| Sample | Consistency % | Mixing Time (minutes) | Properties after Oxygen Delignification: K No. (25 ml) | Viscosity (cps) | GE Brightness |
|---|---|---|---|---|---|
| I | 3.5 | 2 | 15.75 | 23.4 | 24.8 |
| J | 3.5 | 2 | 15.34 | 22.4 | 25.2 |
| K | 3.5 | 15 | 14.78 | 22.6 | 25.9 |
| L | 3.5 | 15 | 15.00 | 22.7 | 25.5 |
| M | 3.0 | 2 | 8.59 | 13.3 | 36.6 |
| N | 3.0 | 2 | 8.29 | 14.2 | 35.3 |
| O | 3.0 | 15 | 8.14 | 13.1 | 36.3 |
| P | 3.0 | 15 | 8.44 | 13.8 | 36.5 |

Due to the increased amount of NaOH mixed with the low consistency pulp, a much greater amount of NaOH is retained on the high consistency pulp. Due to this increased amount of NaOH, samples M-P achieve a decrease in K No. of at least about 56%, while samples I-L, at best, achieve a decrease of only about 24.4%. Again, the samples (M-P) prepared by the present process obtain increased delignification by at least 41.9% compared to the comparative samples. As noted above, this is due to the increased amounts of sodium hydroxide retained upon the high consistency pulp due to the uniform mixing and distribution of appropriate amounts of sodium hydroxide throughout the low consistency pulp.

While it is apparent that the invention herein disclosed is well calculated to fulfill the objectives stated above, it will be appreciated that numerous modifications and embodiments may be devised by those skilled in the art. It is intended that the appended claims cover all such modifications and embodiments as fall within the true spirit and scope of the present invention.

What is claimed is:

1. A process for obtaining enhanced delignification selectivity of brownstock pulp during high consistency oxygen delignification which comprises:

applying alkaline material to brownstock pulp by reducing the consistency of the pulp to less than about 5% by weight to form low consistency pulp, combining the low consistency pulp with a sufficient quantity of alkaline material at a concentration of between about 20 to about 120 g/l by uninterrupted mixing in a manner to ensure that all pulp fibers are exposed to the alkaline material while substantially uniformly distributing the alkaline material throughout the pulp, and then increasing the consistency of the alkaline material containing pump to at least about 18% by weight to obtain high consistency pulp, to remove pressate and to provide an amount of alkaline material on the high consistency pulp of at least about 0.8 to 7 percent by weight based on the oven dry weight of the pulp, said amount of alkaline material being substantially uniformly distributed throughout the high consistency pulp, and said pulp fibers containing the alkaline material being directly passed from the combining step to the consistency increasing step;

recycling greater than 50% of the pressage directly to the alkaline material combining step; and oxygen delignifying the alkaline material containing high consistency pulp to obtain enhanced delignification fo the brownstock pulp without a corresponding decrease in pulp viscosity compared to brownstock pulp which is not combined with alkaline material at low pulp consistencies.

2. The process of claim 1 wherein the brownstock pulp has a consistency which is equal to or greater than that of the high consistency pulp, and wherein substantially all pressate is directly recycled to the alkaline material combining step.

3. The process of claim 1 which further comprises accumulating a predetermined quantity of pressate in order to continuously recycle pressate directly to the alkaline material combining step in the event of intermittent or non-continuous operation of the consistency increasing step.

4. The process of claim 1 which further comprises washing the oxygen delignified pulp, thus generating wash water effluent, and recycling a portion of the wash water effluent for washing the brownstock pulp prior to applying the alkaline material.

5. The process of claim 4 which further comprises recycling a portion of the pressate for washing the brownstock pulp prior to applying the alkaline material.

6. The process of claim 1 wherein the pulp has a low consistency of about 3% by weight when combined with the quantity of alkaline material.

7. The process of claim 1 wherein the consistency of the pulp is increased to between about 25 and 35% by weight prior to oxygen delignification.

8. The process of claim 1 wherein the enhanced delignification selectivity is obtained by decreasing the K No. of the high consistency pulp by greater than 50% without significantly damaging the cellulose components of the pulp.

9. The process of claim 8 wherein the enhanced delignification selectivity is obtained by decreasiong the K No. of the high consistency pulp from about 10 to 26 before delignification to about 5 to 10 after delignification.

10. The process of claim 1 wherein the brownstock pulp is unbleached softwood pulp and the amount of alkaline material applied to said pulp is between about 1.5 and 4 percent by weight.

11. The process of claim 1 wherein the brownstock pulp is unbleached hardwood pulp and the amount of alkaline material applied to said pulp is between about 1 and 3.8 percent by weight.

12. A process for obtaining enhanced delignification selectivity of brownstock pump during high consistency oxygen delignification which comprises:

washing brownstock pulp to an initial consistency;

applying alkaline material to the brownstock pulp by reducing the initial consistency of the washed pulp to less than about 5% by weight to form low consistency pulp, combining the low consistency pulp with a sufficient quantity of alkaline material at a concentration of between about 20 to about 120 g/l by uninterrupted mixign in a manner to ensure that all pulp fibers are exposed to the alkaline material while substantially uniformly distributing the alkaline material throughout the pulp, and then increasing the consistency of the pulp to at least about 25% by weight to obtain high consistency pulp, to remove pressate and to provide an amount of alkaline material on the high consistency pulp of at least about 0.8 to 7 percent by weight based on the oven dry weight of the pulp, said amount of alkaline material being substantially uniformly distributed throughout the high consistency pulp, and said pulp fibers containing the alkaline material being directly passed from the combining step to the consistency increasing step;

recycling greater than 50% of the pressate directly to the alkaline material combining step; and oxygen delignifying the alkaline material containing high consistency pulp to obtain enhanced delignification selectivity of the brownstock pulp without a corresponding decrease in pulp viscosity compared to brownstock pulp which is not combined with alkaline material at low pulp consistencies.

13. The process of claim 12 wherein the brownstock pulp is washed to an initial consistency which is equal to or greater than that of the high consistency pulp, so that substantially all pressate is recycled to the alkaline material combining step.

14. The process of claim 12 wherein the brownstock pulp is washed to an initial consistency which is lower than that of the high consistency pulp, so that at least about 75% of the pressate is recycled to the alkaline material combining step.

15. The process of claim 14 which further comprises directing the balance of the pressate to the brownstock pulp washing step for washing the brownstock pulp.

16. The process of claim 15 which further comprises washing the oxygen delignified pulp, thus generating wash water effluent and recycling a portion of the wash water effluent to the brownstock pulp washing step.

17. The process of claim 12 which further comprises accumulating a predetermined quantity of pressate in order to continuously recycle pressate in the event of intermittent or non-continuous operation of the consistency increasing step, and wherein the enhanced delignification selectivity is obtained by decreasing the K No. of the high consistency pulp by greater than 50% and from about 10 to 26 before delignification to about 5 to 10 after delignification without significantly damaging the cellulose components of the pulp.

18. A process for obtaining increaased delignification of unbleached pulp during high consistency oxygen delignification which comprises:

uniformly mixing unbleached brownstock pulp having a consistency of less than about 5% by weight with a quantity of alkaline material at a concentration of between about 20 to about 120 g/l in an aqueous alkaline solution without interruption for a predetermined time and at a predetermined temperature correlated to the quantity of alkaline material to ensure that all pulp fibers are exposed to the alkaline solution to substantially complete a substantially uniform distribution of alkaline material throughout the pulp;

increasing the consistency of the pulp to at least about 18% by weight after completion of the mixing step by removing liquid from the pulp while retaining at least about 0.8 to 7 percent by weight based on the dry weight of the pulp of alkaline material on the increased consistency pulp for subsequent oxygen delignification, wherein the pulp fibers containing the aqueous alkaline solution are directly passed from the mixign step to the consistency increasing step;

recycling greater than 50% of the liquid removed from the pulp during the consistency increasing step directly to the alkaline material mixing steps; and substantially delignifying the increased consistency alkaline material containing pulp during oxygen delignification to obtain enhanced delignification selectivity of the brownstock pulp without a corresponding decrease in pulp viscosity compared to brownstock pulp which is not combined with alkaline material at low pulp consistencies.

19. The process of claim 18 wherein the unbleached pulp has a consistency of between about 0.5 and 4.5% by weight, and which further comprises increasing the consistency of the pump during the consistency increasing step to at least about 25% by weight.

20. The process of claim 18 wherein at least about 75–95% of the liquid removed from the pulp during the consistency increasing step is directly recycled to the alkaline material mixing step.

21. The process of claim 19 which further comprises obtaining an enhanced delignification selectivity of at least about 50% without significantly damaging the cellulose components of the pulp during oxygen delignification by decreasing the K No. of the high consistency pulp from about 10 to 26 before delignification to about 5 to 10 after delignification.

22. The process of claim 21 wherein the enhanced delignification selectivity is at least about 60%, and which further comprises subjecting the oxygen delignified pulp to a subsequent bleaching process utilizing substantially reduced amounts of bleach chemical compared to a conventional pulp which is not uniformly combined with alkaline material prior to delignification while obtaining substantially the same degree of brightness as the conventional pulp.

23. The process of claim 22 wherein the bleaching agent is chlorine or chlorine dioxide and the total amount of chlorine containing chemicals utilized is reduced by about 15 to 35 percent by weight.

24. The process of claim 22 which further comprises subjecting the bleached pulp to an alkaline extraction step utilizing substantially reduced amounts of alkaline material in said extraction step compared to that needed for subjecting the pulp to conventional alkaline extraction.

25. The process of claim 24 wherein the amount of alkaline material utilized in the extraction step is reduced by about 25 to 40 percent by weight.

* * * * *